US010355398B1

(12) United States Patent
Advey et al.

(10) Patent No.: US 10,355,398 B1
(45) Date of Patent: Jul. 16, 2019

(54) VIBRATION LIMITING COMPRESSION PROTRUSIONS

(71) Applicant: Yazaki North America, Inc., Canton, MI (US)

(72) Inventors: Alexander Advey, Ypsilanti, MI (US); Kevin Shaheen Pakravan, Ann Arbor, MI (US); Jen Vun Ng, Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 15/917,294

(22) Filed: Mar. 9, 2018

(51) Int. Cl.
*H01R 4/38* (2006.01)
*H01R 13/533* (2006.01)
*H01R 13/621* (2006.01)

(52) U.S. Cl.
CPC ..... *H01R 13/533* (2013.01); *H01R 13/6215* (2013.01)

(58) Field of Classification Search
CPC ..... H01R 13/748; B60T 6/3685
USPC ..... 439/362, 382, 383, 564, 573, 384; 248/635
See application file for complete search history.

(56) References Cited

U.S. PATENT DOCUMENTS 1,622,267 A * 3/1927 Alden ..... H01R 33/7664 439/384
2,560,212 A * 7/1951 Byrd ..... F16F 1/3732 174/138 G
2,843,833 A * 7/1958 Edwards ..... H01R 33/7678 174/153 R
3,128,999 A * 4/1964 Schmitt ..... F16B 5/0233 267/153
3,251,460 A 5/1966 Edmonds
4,067,531 A * 1/1978 Sikula ..... B62D 25/12 123/198 E
4,521,004 A * 6/1985 Caldwell ..... F16F 1/3732 267/141.4
4,522,378 A * 6/1985 Nelson ..... F16B 5/0258 16/2.1
4,711,135 A 12/1987 Horiuchi et al.
4,753,601 A * 6/1988 Cobaugh ..... H05K 3/306 29/837
5,306,459 A 4/1994 Thomason et al.
5,947,766 A * 9/1999 Tsuji ..... H01R 13/748 439/559
6,152,913 A 11/2000 Feith et al.
6,206,718 B1 * 3/2001 Takahashi ..... H01R 4/308 439/382
6,890,211 B2 * 5/2005 Inagaki ..... H01R 13/748 362/492

(Continued)

*Primary Examiner* — Neil Abrams
(74) *Attorney, Agent, or Firm* — Foley & Lardner LLP

(57) ABSTRACT

A connector comprises a connector housing that includes a plurality of channels formed therein through which a corresponding plurality of fasteners may pass. At least a portion of the housing has a first side and a second side. The first side is an elongated body-receiving side and the second side is a mating side. The elongated body may, for example, be a wire, a cable, a hose, or other structure. Each of the channels has an opening. The connector further comprises protrusions extending away from each of the openings. In an unassembled state, the protrusions extend further away from a surface of the housing than a remainder of the mating surface of the connector.

20 Claims, 2 Drawing Sheets

(56) References Cited

U.S. PATENT DOCUMENTS

| | | | | |
|---|---|---|---|---|
| 7,097,498 | B2 * | 8/2006 | Miyazaki | H01R 4/46 439/362 |
| 7,658,643 | B2 * | 2/2010 | Tuerschmann | H01R 12/7047 439/564 |
| 8,167,641 | B2 * | 5/2012 | Thackston | H01R 13/748 439/382 |
| 8,366,468 | B2 * | 2/2013 | Carnevali | G06F 1/1632 439/248 |
| 8,474,804 | B2 * | 7/2013 | Masterson | F16F 1/3732 267/141 |
| 8,662,910 | B2 * | 3/2014 | Ichio | H01R 13/5208 439/206 |
| 8,740,632 | B2 * | 6/2014 | Osawa | H01R 13/50 439/76.2 |
| 8,771,003 | B2 * | 7/2014 | Reibke | H01R 13/748 439/372 |
| 8,992,249 | B2 * | 3/2015 | Kobayashi | H01R 13/6591 439/362 |
| 9,478,909 | B2 * | 10/2016 | Shimizu | H01R 13/5227 |
| 9,484,667 | B2 * | 11/2016 | Ichio | B60L 11/1818 |
| 9,543,713 | B2 * | 1/2017 | Shimizu | H01R 13/6616 |
| 9,548,144 | B2 * | 1/2017 | Blazic | H05K 5/0073 |
| 9,887,479 | B2 * | 2/2018 | Mukuno | H01R 13/245 |

* cited by examiner

VIBRATION LIMITING COMPRESSION PROTRUSIONS

TECHNICAL FIELD

The present application relates generally to the field of connectors. In particular, the embodiments of the present invention relate to a device and method for limiting vibration of a connector assembly.

BACKGROUND

A connector assembly may sometimes include one or more structures configured to limit vibration of one or both of the mating connectors of the connector assembly. The structures, for example, may be formed of an elastomeric or other material. In some situations, this structure may be degraded when the two connectors are mated. For example, bolts or other devices may be used to keep the mated connectors fastened together, and the structure may become degraded when the bolts are tightened to mate the two connectors. Such a process may cause physical removal of a portion of the vibration-limiting structure (e.g., via shaving), which then creates debris that may contaminate or impede function of the components of the connector assembly. Additionally or alternatively, the structure may become sufficiently degraded such that the structure no longer operates properly, leading to vibration, high plastic compression, and possible cracks of various components of the connector assembly. Therefore, an ongoing need exists for improved designs that allow for such connector assemblies to limit vibration of respective components of the connector assembly.

SUMMARY OF THE INVENTION

In an example embodiment, a connector comprises a connector housing that includes a plurality of channels formed therein through which a corresponding plurality of fasteners may pass. At least a portion of the housing has a first side and a second side. The first side is an elongated body-receiving side and the second side is a mating side. Each of the channels has an opening. The connector further comprises protrusions extending away from each of the openings. In an unassembled state, the protrusions extend further away from a surface of the housing than a remainder of the mating surface of the connector.

In other example embodiments, a connector assembly comprises a plurality of fasteners, a first connector, and a second connector. The second connector mates to the first connector. The second connector further comprises a connector housing, a plurality of collars, and protrusions extending away from the plurality of collars. The housing comprising a flange having a first side and a second side. The flange has a plurality of channels formed therein. The plurality of channels each having a first opening on a first side of the flange and a second opening on the second side of the flange. The first side of the flange is configured to mate with the first connector when the connector assembly is in an assembled state. The plurality of collars are disposed with the plurality of channels and are configured to receive the plurality of fasteners. The protrusions extend away from each of the collars on the first side of the flange. In an unassembled state of the connector assembly, the protrusions extend further away from a surface of the housing than the collars. In an assembled state of the connector assembly, the protrusions are in contact with the first connector. The protrusions are compressed and absorb plastic deformation to thereby limit vibration associated with relative motion between the first connector and the second connector.

These and other features of the implementations described herein, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1:
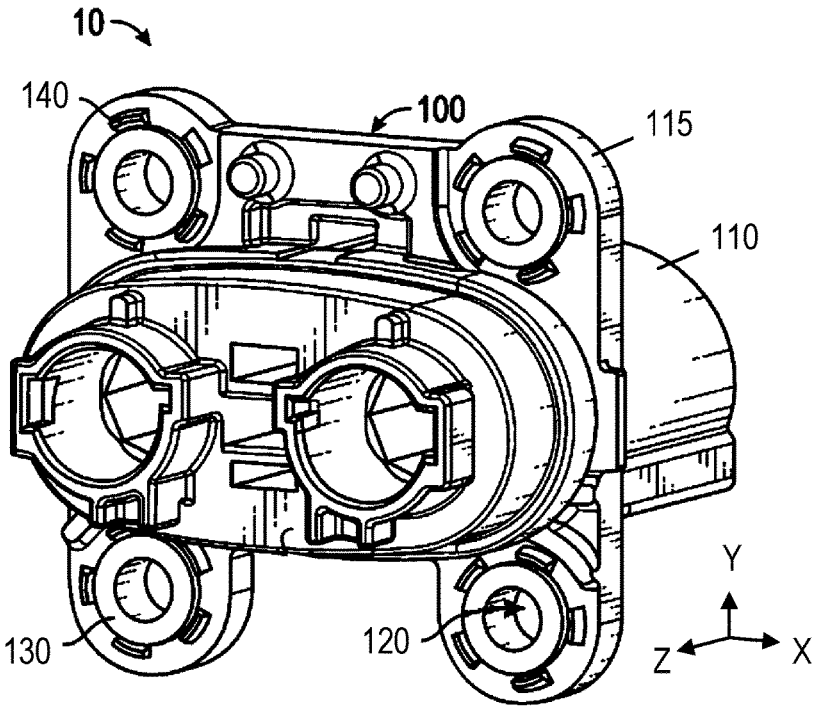
FIG. 1 illustrates a front view of a connector assembly according to an example embodiment.
Figure 2:
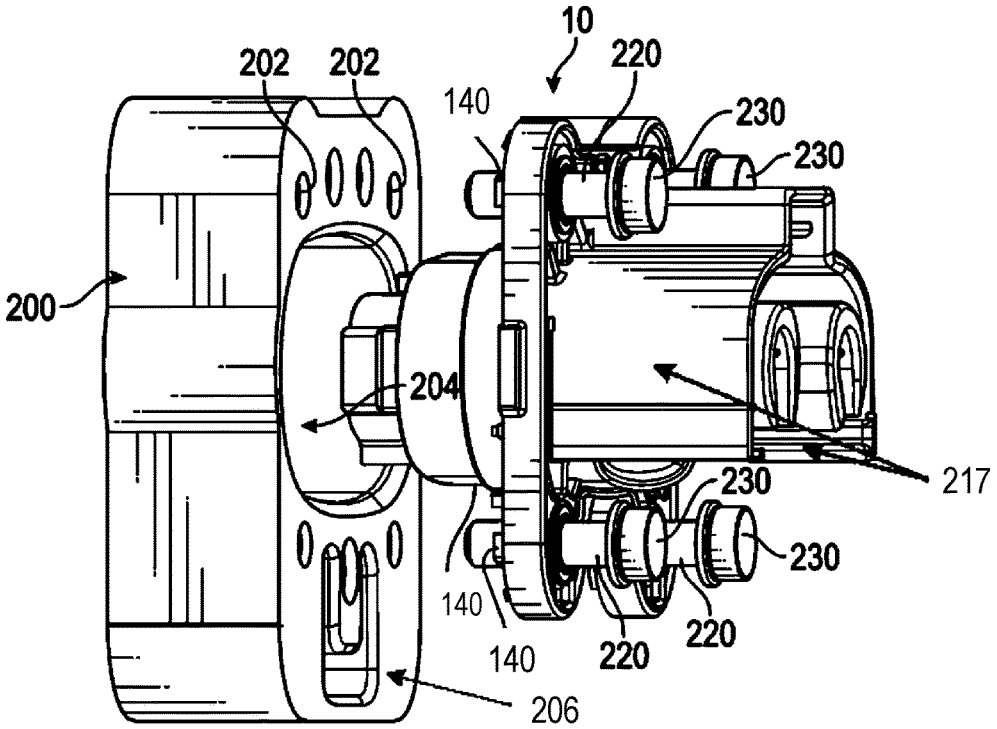
FIG. 2 illustrates a side view of a connector assembly according to an example embodiment.

Referring first to FIGS. 1 and 2, a connector assembly 10 that includes a vibration limiting mechanism is described. The connector assembly includes a first connector 100 and a second connector 200. The first connector 100 may be configured to be attached to an elongated body, and the second connector 200 may comprise a module 206 that is configured to be attached to a surface (not shown). In some examples, the elongated body may comprise a wire or cable structured to transmit electricity (e.g., electric power and/or electric signals). In some examples, the elongated body may comprise a cable structured to transmit light (i.e., a fiber optic cable). In some examples, the elongated body may comprise tubing structured to transmit fluid (e.g., gas and/or liquid). Thus, in some embodiments, the connectors 100 and 200 are used to make electrical connections. In other embodiments, the connectors 100 and 200 are used to make other connections, such as fluid or optical connections. For purposes of providing an example, it will be assumed in the remaining discussion of FIGS. 1 and 2 that the elongated body is a cable structured to transmit electricity.

The module 206 has an opening 204 defined therein that is configured to receive a portion of the first connector 100. For sake of simplicity, certain components (e.g., wires, pins, sockets, and other structure) are not shown in FIGS. 1 and 2. As shown most clearly in FIG. 1, the connector 100 comprises a housing 110. The housing 110 may be formed of a rigid material, such as a thermoplastic material. In other embodiments, other materials may be used, such as metal. The housing 110 further includes a flange 115 which further includes a plurality of channels 120. The channels 120 are configured to receive fasteners (e.g., bolts 220 having bolt heads 230) that attach the connector 100 to the module 206. For purposes of description, FIG. 1 shows an orthogonal XYZ coordinate system that is defined by the flange 115, wherein the flange defines a plane that defines X and Y axes, and wherein the channels 120 extend in a Z direction that is perpendicular to the XY plane defined by the flange 115.

As depicted, disposed within the plurality channels 120 are a plurality of collars 130 (i.e., in a press-fit collar application). The collars 130 may be formed of a rigid material, such as metal, thermoplastic, etc. As used herein, the term "collar" may be used to refer to a band, ring, cover, or sleeve structured to be disposed within a channel. In some embodiments, the collar 120 may measure a length (L), width (W), and/or cross-section. The measurements may be uniform throughout the collar 120. In some examples, the measurements may be non-uniform throughout the collar 120. In this regard, the collar 120 may comprise a plurality of diameters, lengths, and widths to restrain, fix, and/or connect one or more components of the connector assembly 100.

Located about the circumference of each of the collars 130 are one or more protrusions 140 (e.g., vibration-limiting compression ribs). The protrusions 140 may, for example, be formed of an elastomeric material. In the illustrated embodiments, a plurality of protrusions 140 are provided that are spaced about the circumference of the collars 130. In other embodiments, a single protrusion 140 may be provided that extends continuously about the circumference of the collars 130.

As described further below, the protrusions 140 are structured to limit the vibration of the housing 110 relative to the module 206. The protrusions 140 protrude slightly above the height of the collars 130 (i.e., slightly further away from the surface of the flange 115 in the Z direction). The protrusions 140 may be located on a common XY plane defined by the flange 115, but have different respective locations on the XY plane. As used herein the term "protrusion" may be used to refer to a raised portion, surface, or area, structured to limit or otherwise eliminate vibration, rattle, etc. of various components of the connector assembly 10. In some embodiments, the protrusion 110 may take the form of a rib (e.g., a compression rib), crush bump, or another extending portion. In an assembled state, the protrusions are located between the housing 110 and the module 206. The protrusions 140 may be formed along, formed within, or otherwise coupled to the housing 100. For example, the protrusion 110 may be affixed to the housing 100. In other embodiments, the protrusion 110 may be coupled to the module 206.

The fasteners 220 are structured to couple the housing 110 to the module 206. In some embodiments, the fastener 220 (e.g., a bolt) may be threadably coupled to the module 206 such that the fastener 220 engages with the fastener 220 via a forward (clockwise) rotation or backward rotation in a threaded opening 202 on the module 206. The fastener 220 may be received by the housing 100 via the channel 120 such that the fastener 220 may extend in the Z direction through the channel 120 and into the threaded opening 202. The fastener 220 may comprise a fastener head 230. The fastener head 230 may prevent at least a portion of the fastener 220 from moving through the channel 120. For example, one or more dimensions in the XY direction, such as the diameter, of the fastener head 230 may be larger than one or more dimensions of the channel 120 to prevent at least a portion of the fastener 200 from moving through the channel 120.

In operation, when the housing 110 is mounted to the module 206, the bolts 220 drive the protrusions 140 against the surface of the module 206. As the bolts 220 are fastened, the clamp load compresses the protrusions 140 and flange 115 between the bolt head 230 and the module 206. The protrusions 140 thus flatten slightly to create pressurized contact on the surface. In such an arrangement, protrusions 140 create firm points of contact after mounting, and no gaps are left for rattling of the housing 110 against the module 206. The protrusions 140 absorb compressive deformation and restrict relative motion between the housing 110 and the module 206, yielding a mating condition without vibration. Further, because the protrusions 140 are an opposite side of the flange 115 relative to the bolt head 230, the rotational motion of the bolt head 230 does not scrape off any of the surface of the protrusions 140. Additionally, high strain areas are localized to the protrusions 140, prevent possible cracks to the flange 115. Permanent deformation is limited to the protrusions 140 instead of the flange 115.

Figure 3:
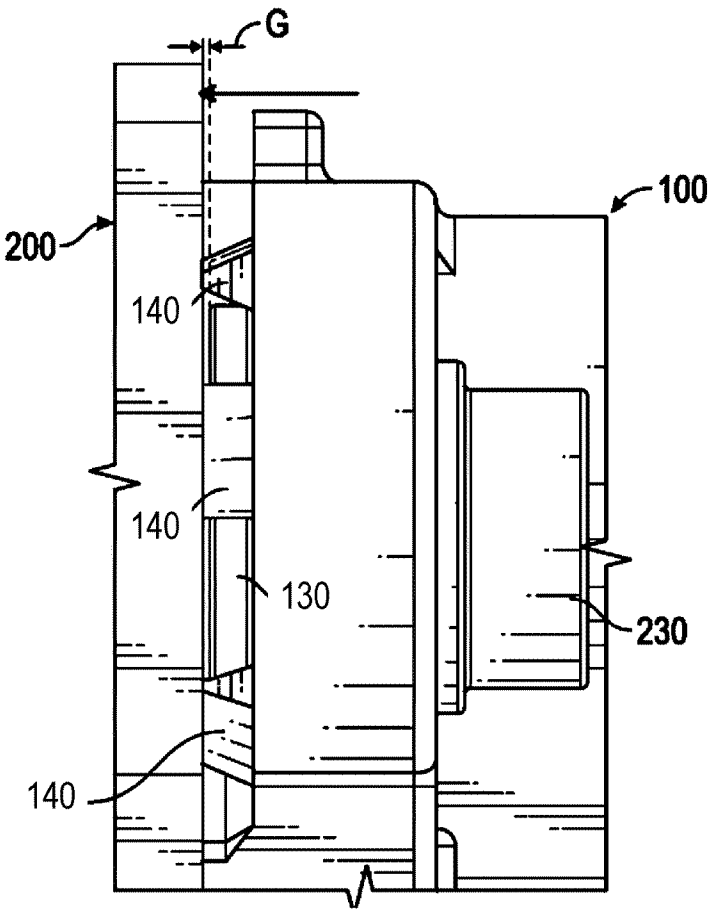
FIG. 3 illustrates a magnified and cropped side view of a connector assembly according to an example embodiment; and It will be recognized that some or all of the figures are schematic representations for purposes of illustration. The figures are provided for the purpose of illustrating one or more implementations with the explicit understanding that they will not be used to limit the scope or the meaning of the claims.

FIG. 3 is a magnified and cropped side view of the connector assembly 10. As more clearly depicted in FIG. 3, before mating, a height of the protrusion 140 (e.g., a compressible rib) may be greater than a height of the collar 130 (e.g., a press-fit collar) in the Z direction. For example, the protrusion 140 may protrude above the height of the collar 130. The protrusion 140 may protrude above the height of the collar 130 prior to mating with the module 206. When the housing 100 is mated with (e.g., mounted to or otherwise connected to) the module 206, the protrusion 140 creates a firm contact between the module 206 and the housing 110. In such embodiments, the fastener 220 (e.g., a bolt) may drive the protrusion 110 against the module 206 (e.g., against the module 206) to create the pressurized contact along the module 206. Advantageously, the compressibility of the protrusion 110 removes the initial gap G (e.g., the compression distance as shown in FIG. 3) which tightens the fit between the module 206, the housing 100, and various components of the connector assembly 10 and removes or limits the ability of the module 206, the housing 100, and/or the various components of the connector assembly 10 to vibrate, rattle, etc.

The protrusions 140 may be disposed opposite of the fastener head 230 (e.g., displaced from the fastener head 230 in the Z-direction, separated by the flange 115, such that the protrusions 140 and the fastener head 230 are on opposite sides of the flange 115). As such, the rotational motion of the fastener head 230 may not cause wear, damage, deformation, or defects to the protrusion 140. For example, when the protrusion 140 is disposed opposite of the fastener head 230, the rotational motion of the fastener head 230 will not scrape off, shave, or otherwise deform the protrusion 140. Alternatively or additionally, since there is not any deformation (e.g., shavings resulting in debris) to, for example, the surface of the protrusion 140, there is no additional cleaning process and/or contamination of the module 206. In this regard, as the fastener 220 (e.g., the bolt) is fastened, the clamp load compresses the material (e.g., the polymer, plastic, composite, etc.) between the fastener head 230 and the module 206. In such embodiments, high-strain areas may be localized to the protrusion 140 (e.g., the compression rib) which advantageously prevents possible wear, damage, or defects (e.g., cracks) to the flange 115 such that the flange 115 is protected from cracking during fastener torquing.

The connector assembly 10 may be used in various applications. For example, the connector assembly 10 may be used in vehicle applications such as in connection with a motor (e.g., an electric motor), engine (e.g., an internal combustion engine, gasoline engine, jet engine, steam engine, hybrid engine, etc.), propeller, rail, road, air, water, etc. The connector assembly 10 may be utilized interior or exterior to the vehicle. In further embodiments, the housing 100 may be structured (e.g., sized and shaped) to accommodate different sizes, numbers, or types of components, assemblies, devices, wires, etc.

While this specification contains many specific embodiment details, these should not be construed as limitations on the scope of what may be claimed, but rather as descriptions of features specific to particular embodiments. Certain features described in this specification in the context of separate embodiments can also be implemented in combination in a single embodiment. Conversely, various features described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a sub combination or variation of a subcombination.

As utilized herein, the terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary embodiments is illustrative only and not restrictive in character. All changes and modifications that come within the spirit and/or scope of the described embodiments are desired to be protected. It should be understood that some features may not be necessary and embodiments lacking the various features may be contemplated as within the scope of the application, the scope being defined by the claims that follow. When the language "at least a portion" and/or "a portion" is used the item can include a portion and/or the entire item unless specifically stated to the contrary.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. A connector comprising:

a connector housing, the connector housing having a plurality of channels formed therein through which a corresponding plurality of fasteners may pass, wherein at least a portion of the housing has a first side and a second side, the first side being an elongated body-receiving side and the second side being a mating side, and wherein each of the channels extends between an opening formed in each of the first side and the second side of the connector housing;

a plurality of collars, the plurality of collars being disposed within the plurality of channels formed in the connector housing and being configured to receive the plurality of fasteners; and protrusions extending about each of the openings formed in the second side of the connector housing, wherein an innermost surface defined by each protrusion is located radially outwards relative to an outermost periphery of the opening in the second side of the connector housing about which the protrusion extends;

wherein in an unassembled state the protrusions extend away from the second side of the connector housing by a first distance, and in an assembled state the protrusions extend away from the second side of the connector housing by a second distance, the first distance being greater than the second distance; and wherein the protrusions extend further away from the second side of the surface of the connector housing than the collars.

2. The connector of claim 1, wherein the elongated body comprises one or more of wire, cable, and tubing.

3. The connector of claim 1, wherein the collars are press-fit collars.

4. The connector of claim 3, wherein connector housing is structured to be coupled to a module via the plurality of fasteners.

5. The connector of claim 4, wherein the plurality of fasteners drive the protrusions against the module.

6. The connector of claim 1, wherein the connector housing further comprises a flange, the flange defining the first side and the second side of the connector housing.

7. The connector of claim 5, wherein the protrusions are structured to restrict relative motion between the housing and the module.

8. The connector of claim 7, wherein strain in an assembled state of the connector housing and the module is localized to the protrusions.

9. A connector assembly comprising:

a plurality of fasteners;

a first connector; and a second connector, the second connector comprising:

a connector housing, the connector housing comprising a flange, the flange having a first side and a second side, the flange having a plurality of channels formed therein, the plurality of channels each defined by a flange inner wall structure that extends between a first opening formed on a first side of the flange and a second opening formed on the second side of the flange, the first side of the flange being configured to mate with the first connector when the connector assembly is in an assembled state;

a plurality of collars, the plurality of collars being disposed within the plurality of channels and being configured to receive the plurality of fasteners, wherein at least a portion of an exterior surface of each collar is in direct contact with the flange inner wall structure defining the channel within which each collar is disposed; and protrusions extending away from each of the collars on the first side of the flange;

wherein, in an unassembled state of the connector assembly, the protrusions extend further away from a surface of the housing than the collars; and wherein, in the assembled state of the connector assembly, the protrusions are in contact with the first connector in a compressed state and absorb compressive deformation to thereby limit vibration associated with relative motion between the first connector and the second connector.

10. The connector assembly of claim 9 wherein, in the assembled state, the protrusions are driven against the first connector by the fasteners.

11. The connector assembly of claim 9 wherein, in the assembled state, fastener heads of the plurality of fasteners are disposed on the second side of the flange.

12. The connector assembly of claim 9, wherein strain in an assembled state of the connector housing and the module is localized to the protrusions.

13. The connector assembly of claim 9, wherein the collars are press-fit collars.

14. A connector kit comprising:

a first connector; and a second connector, the second connector comprising:

a connector housing, the connector housing comprising a flange, the flange having a first side and a second side, the flange having a plurality of channels formed therein, the plurality of channels each defined between a first opening formed on a first side of the flange and a second opening formed on the second side of the flange, the first side of the flange being configured to mate with the first connector when the connector assembly is in an assembled state;

a plurality of collars, the plurality of collars being disposed within the plurality of channels and being configured to receive a fastener; and protrusions extending about the first openings formed on the first side of the flange, wherein an innermost surface defined by each protrusion is located radially outwards relative to an outermost periphery of the first opening about which the protrusion extends;

wherein, in an unassembled state of the connector assembly, the protrusions extend further away from a surface of the housing than the collars; and wherein, in the assembled state of the connector assembly, the protrusions are in contact with the first connector in a compressed state and absorb plastic deformation to thereby limit vibration associated with relative motion between the first connector and the second connector.

15. The connector kit of claim 14 wherein, in the assembled state, are driven against the first connector by the fasteners.

16. The connector kit of claim 14 wherein, in the assembled state, fastener heads of the plurality of fasteners are disposed on the second side of the flange.

17. The connector kit of claim 14, wherein strain in an assembled state of the connector housing and the module is localized to the protrusions.

18. The connector kit of claim 14, wherein the collars are press-fit collars.

19. The connector kit of claim 14, wherein each protrusion extends interruptedly about a first opening.

20. The connector kit of claim 14, wherein each protrusion extends continuously about a first opening.

* * * * *